US006060975A

United States Patent [19]

Rowe

[11] Patent Number: 6,060,975

[45] Date of Patent: May 9, 2000

[54] BOBBIN WITH INTEGRAL SUPPORT TABS

[75] Inventor: Franklin Rowe, Dousman, Wis.

[73] Assignee: Trans-Coil, Inc., Milwaukee, Wis.

[21] Appl. No.: 09/052,202

[22] Filed: Mar. 31, 1998

[51] Int. Cl.[7] ..... H01F 27/29; H01F 27/30

[52] U.S. Cl. ..... 336/198; 336/192; 336/208

[58] Field of Search ..... 336/198, 208, 336/192

[56] References Cited

U.S. PATENT DOCUMENTS

| | | | |
|---|---|---|---|
| 799,156 | 9/1905 | Goldberg | 336/208 |
| 1,940,638 | 12/1933 | West | 336/208 |
| 1,984,244 | 12/1934 | Wilson | 336/208 |
| 2,428,826 | 10/1947 | Bauer | 336/208 |
| 2,429,355 | 10/1947 | Goldschmidt | 242/71 |
| 3,467,932 | 9/1969 | Feather | 336/197 |
| 3,605,055 | 9/1971 | Grady | 336/185 |
| 3,675,174 | 7/1972 | Horbach | 335/299 |
| 3,843,946 | 10/1974 | Anderson et al. | 336/90 |
| 4,636,763 | 1/1987 | Nabstedt et al. | 336/192 |
| 4,691,746 | 9/1987 | Sedgewick | 140/92.1 |
| 4,700,166 | 10/1987 | Bradt et al. | 336/175 |
| 4,771,958 | 9/1988 | Hewitt | 242/7.03 |
| 4,980,664 | 12/1990 | Harwood | 336/192 |
| 5,114,086 | 5/1992 | Ho | 242/7.03 |
| 5,582,357 | 12/1996 | Kosaka et al. | 242/444.1 |
| 5,673,013 | 9/1997 | Moody et al. | 336/192 |

FOREIGN PATENT DOCUMENTS

| | | | |
|---|---|---|---|
| 1 243 690 | 8/1971 | United Kingdom | 336/208 |

*Primary Examiner*—Michael L. Gellner
*Assistant Examiner*—Anh Mai
*Attorney, Agent, or Firm*—Godfrey & Kahn, S.C.

[57] ABSTRACT

A bobbin for use in a three-phase line reactor. The bobbin includes a tubular main body with a first end, a second end, a first side, a second side, and a core that extends from the first end to the second end. The main body also has two radially-extending flanges; one on its first end and another on its second end. Four tabs extend axially from the main body and are integral with it. A first tab is positioned on the first end of the main body extending from the first side and a second tab is positioned opposite the first tab on the second side. A third tab is positioned on the second end of the main body extending from the first side and a fourth tab is positioned opposite the third tab on the second side. The integral tabs eliminate the need for metal support bars used to hold and align laminations inserted into the cores of the bobbins. Thus, fixing laminations in place is more accurate and repeatable than with prior bobbins. Further, since the tabs may be sized and shaped exactly, precise alignment of the components of a three phase reactor is possible. The bobbin may include ridged sidewalls which enhance the strength of the bobbin. The ridges may also be designed to enhance camber control and spacing of the wire coil wound on the bobbin.

12 Claims, 4 Drawing Sheets

BOBBIN WITH INTEGRAL SUPPORT TABS

FIELD OF THE INVENTION

The present invention relates generally to bobbins on which wire coils are wound and, more particularly, to bobbins used in three-phase line reactors.

BACKGROUND OF THE INVENTION

As is known, reactors are used to introduce reactance into a circuit. Generally, the function of a reactor is to control AC current. Three-phase line reactors have particular usefulness in adjustable-speed motor control applications and a known three-phase reactor 10 is shown in FIG. 1.

Three-phase line reactors, like the one shown in FIG. 1, are constructed from three coils of wire wound on bobbins. Each of the bobbins has a rectangularly-shaped main body 11 with first and second ends 12 and 13. Radially extending flanges 14 and 15 are positioned on each of the first and second ends 12 and 13, respectively, and wire is coiled between the two flanges. Thus, each bobbin holds a coil of wire which acts as an inductor. To enhance the performance of the wire coil, particularly its magnetic field characteristics, a magnetic material is often positioned in its hollow center as a magnetic core. One way of constructing a magnetic core in a bobbin wound with wire is to position a stack of flat metal sheets or laminations through the hollow portion of the bobbin. Often, but not necessarily, E-shape laminations (often called "E's") are used. Sometimes, bar-shaped laminations (often called "I's") are used. It is also common to use both E's and I's.

In reactors with three bobbins, the laminations are built up until they fill nearly the entire hollow center portion of each bobbin. When E's and I' are used, it is common to position the E's so that only the legs of each E are surrounded by the bobbins while the ends of each E are accessible and exposed. A stack of I's is positioned on the opposite side of the bobbins to complete the magnetic circuit. To firmly fix the E and I laminations in place, two metal support bars are inserted into each bobbin. Specifically, a first metal support bar 16 is inserted between the front wall of the bobbin and the top of the laminations and a second metal support bar 18 is inserted between the rear wall of the bobbin and the bottom of the laminations. Bolts 20 are inserted through bores in the metal support bars and the laminations and secured with nuts to tightly hold the laminations together and in place. Usually, two flanges (F and F') are bolted onto the ends of the metal support bars to provide a base on which the reactor stands.

One problem with the present method of constructing three-phase line reactors is the difficulty of aligning the components of the reactor before they are bolted together and maintaining that alignment during the bolting operation. As described above, numerous laminations must be stacked during the construction of the reactor and then these laminations must be fixed in position using several metal support bars. The support bars are manually aligned and bolted in place. Even when this process is carried out using a jig, the resulting reactor is often out of level, out of plumb, or both. Furthermore, the process of inserting and aligning the support bars is time consuming. Thus, the speed at which line reactors can be manufactured is limited. Metal support bars are also sources of eddy current losses in the reactor. Accordingly, it would be desirable to construct a line reactor without having to use metal support bars.

OBJECTS AND SUMMARY OF THE INVENTION

Therefore, it is an object of the present invention to provide a line reactor that may be constructed without metal support bars.

It is another object of the present invention to provide a bobbin with specific features that eliminate the need for support bars in a three-phase line reactor.

These and other objectives are achieved in a bobbin for use in a reactor that includes a tubular main body, preferably shaped like a rectangular tube. The main body has a first end, a second end, a first side, a second side, and a core that extends from the first end to the second end. The main body also has two radially-extending flanges; one on its first end and another on its second end. Four tabs extend axially from the main body and are integral with it. A first tab is positioned on the first end of the main body extending from the first side and a second tab is positioned opposite the first tab on the second side. A third tab is positioned on the second end of the main body extending from the first side and a fourth tab is positioned opposite the third tab on the second side.

The first and second sides of the bobbin are substantially smooth. Third and fourth walls or sides that are opposite each other and adjacent to the first and second sides are designed with special features to increase the strength and performance of the bobbin. Specifically, each third and fourth side may have a plurality of ridges in a lattice or waffle pattern. Optionally, the third and fourth sides may be molded in a shape, such as a semi-circular cross-sectional shape, that has greater strength than a simple rectangular cross-sectional shape. Furthermore, each ridged side has a prominent longitudinally-oriented central rib that enhances camber control and spacing in the coil created by winding wire on the bobbin.

These are just some of the features and advantages of the present invention. Many others will become apparent by reference to the detailed description of the invention taken in combination with the accompanying drawings.

DETAILED DESCRIPTION

Figure 1:
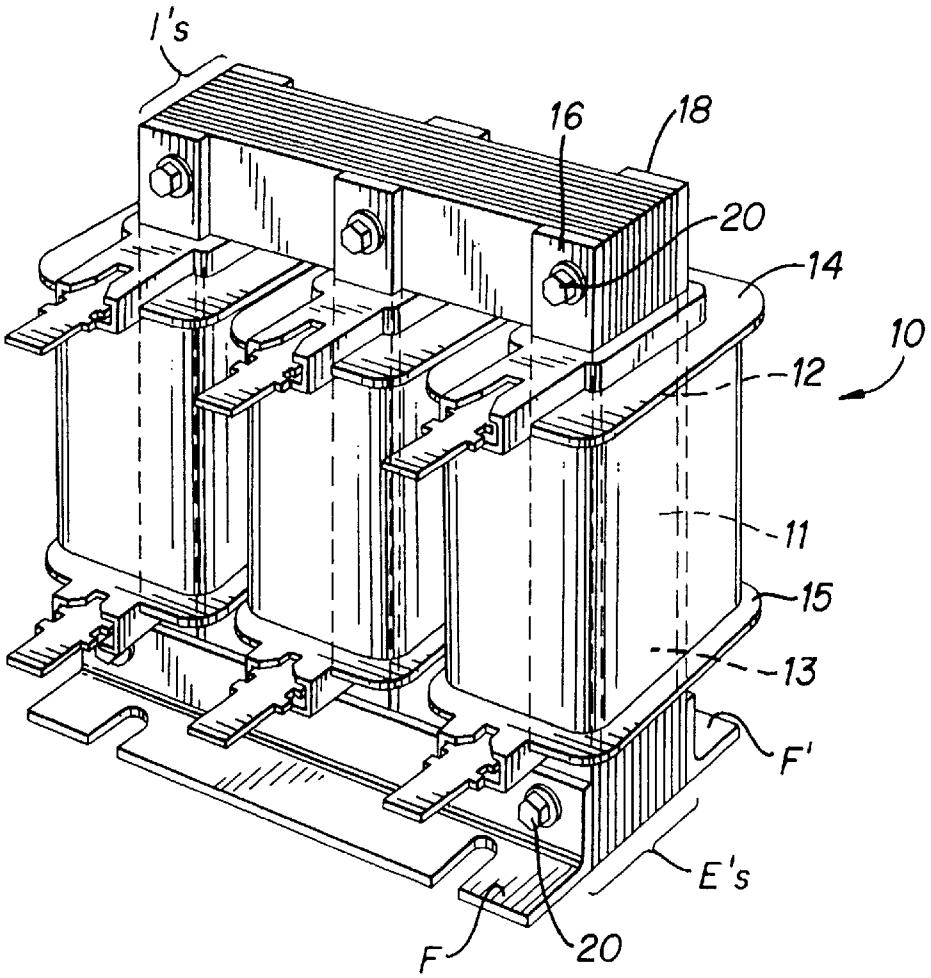
FIG. 1 PRIOR ART
FIG. 1 is a perspective view of a known three-phase line reactor.
Figure 2:
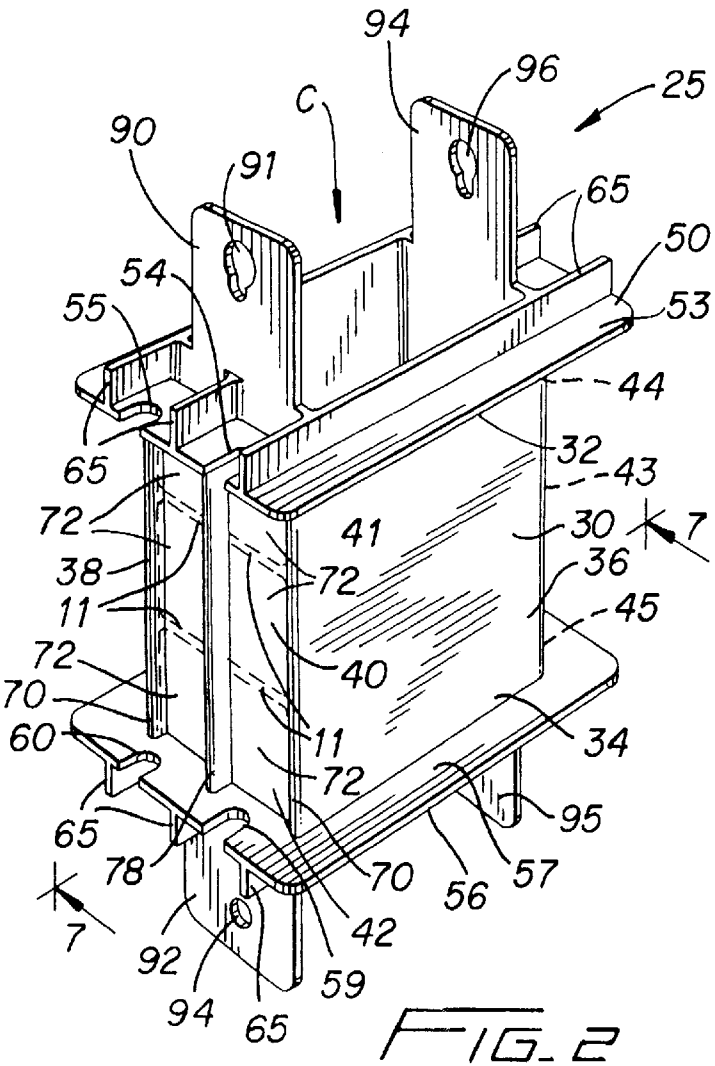
FIG. 2 is a perspective view of a bobbin of the present invention.
Figure 3:
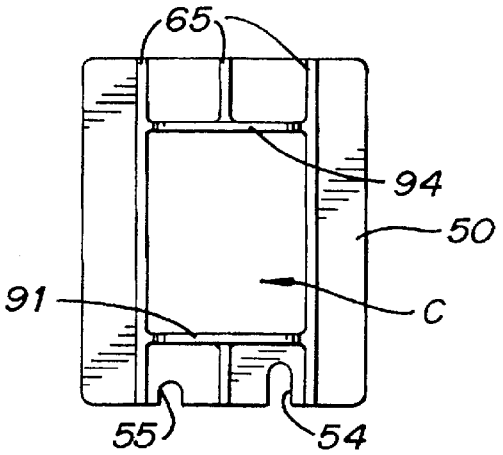
FIG. 3 is a first end view of the bobbin of the present invention.

A bobbin 25 made in accordance with the teachings of the present invention is shown in FIG. 2. The bobbin 25 includes a tubular main body 30 which is rectangularly shaped. The main body 30 has a first end 32; a second end 34; a first substantially smooth side or wall 36; a second oppositely positioned and substantially smooth side or wall 38; a third side or wall 40 having a first end 41 and a second end 42; and a fourth side or wall 43 that is positioned opposite the third wall 40 and has a first end 44 and a second end 45. The walls 36, 38, 40, and 43 define a hollow core C that extends from the first ends to the second ends of the walls 40 and 43. The bobbin 25 and all of its parts are injection molded from non-conductive material as a single piece. Materials suitable for manufacturing the bobbin 25 include glass-reinforced polyester such as that available from Du Pont under the trademark Rynite™ (product no. FR530) and nylons, including glass filled nylons sold under the trademark Zytel™ (product no. 70G33L), also available from Du Pont.

Figure 4:
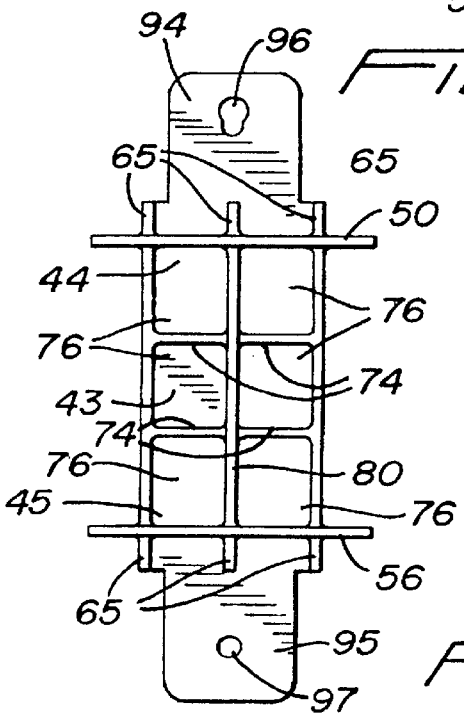
FIG. 4 is a first side elevational view of the bobbin of the present invention.
Figure 6:
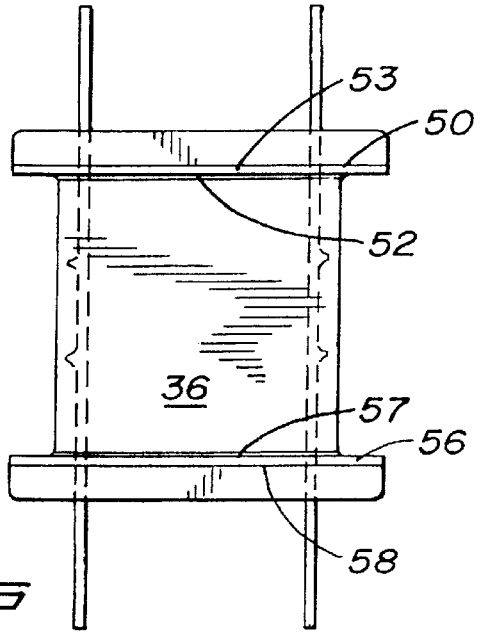
FIG. 6 is a second side elevational view of the bobbin of the present invention.
Figure 5:
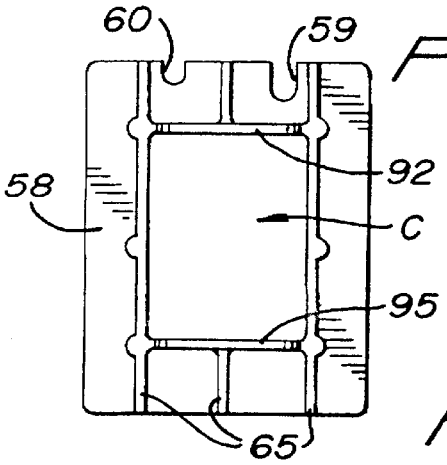
FIG. 5 is a second end view of the bobbin of the present invention.

Integral with the first end 32 of the main body 30 is a first radially extending flange 50 having an inner surface 52 (FIG. 6), an outer surface 53, a feed slot 54, and an exit slot 55. A second radially extending flange 56 is integral with the second end 34. The second flange 56 has an inner surface 57, an outer surface 58 (FIG. 6), a feed slot 59, and an exit slot 60. Each of the flanges may have large ridges 65 (FIG. 4) perpendicular to their outer surfaces 53 and 58 to provide additional strength to them.

The space between the flanges 50 and 56 may be wound, using conventional winding machinery and techniques, with wire to produce a wire coil. Wire is fed through one of the feed slots 54, 59, wound around the space between the flanges 50 and 56, and led out from between the spaces through one of the exit slots 55, 60. Two feed and exit slots are provided so that the bobbin 25 does not have to be oriented in a specific manner in order to wind wire around it.

Figure 7:
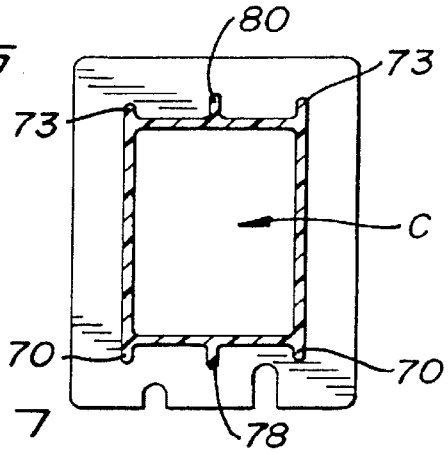
FIG. 7 is a cross-sectional view of the bobbin of the present invention taken along the line 7—7 of FIG. 2.

The third side or wall 40 includes two end ridges 70 (FIGS. 2 and 7) and a plurality of horizontal ridges 71 which define a plurality of depressions 72. Similarly, the fourth side or wall 42 (FIG. 4) includes two end ridges 73 and a plurality of horizontal ridges 74 which define depressions 76. The ridges 71 and 74 increase the strength of the walls 40 and 42 and their ability to resist being crushed or cracked when wire is wrapped around the bobbin 25. Each wall also has a longitudinally oriented rib 78 and 80, respectively (FIG. 7). Each rib 78, 80 extends outwardly from its wall above the ridges and helps to provide camber control in the coil created by winding wire on the bobbin 25 and to maintain exact spacing of the sides of the winding. Typically, the ribs 78 and 80 extend about 1 to 3 mm above the tops of the ridges 71 and 74. However, the height of the ridges 71 and 74 will depend on the strength required as determined by the size of the wire coiled on the bobbin.

Integral with the first end 41 of the third side wall 40 is a first tab 90 having a bore 91. The second end 42 of the third side wall 40 has a tab 92 with a bore 94. Similarly, the first and second ends 44 and 45 of the fourth side wall 43 have integral tabs 94 and 95, respectively. The tabs 94 and 95 have bores 96 and 97. The tabs 90 and 92 and the tabs 94 and 95 extend axially beyond the ends of the third and fourth side walls 40 and 43, respectively. When three bobbins are used to form a three-phase line reactor, the tabs function similarly to the metal support bars used in prior devices. However, the tabs 90, 92, 94, 95 provide superior performance because they may be molded and machined with precision, which reduces or eliminates the problems associated with aligning the components of three-phase reactors. In addition, the tabs on each bobbin may be manufactured to a desired size within precise tolerances. Therefore, achieving a level and plumb three-phase reactor is easier than with prior components. In addition, since the tabs are molded from non-conductive material, eddy current losses are eliminated because induced currents are not generated in the tabs.

Figure 8:
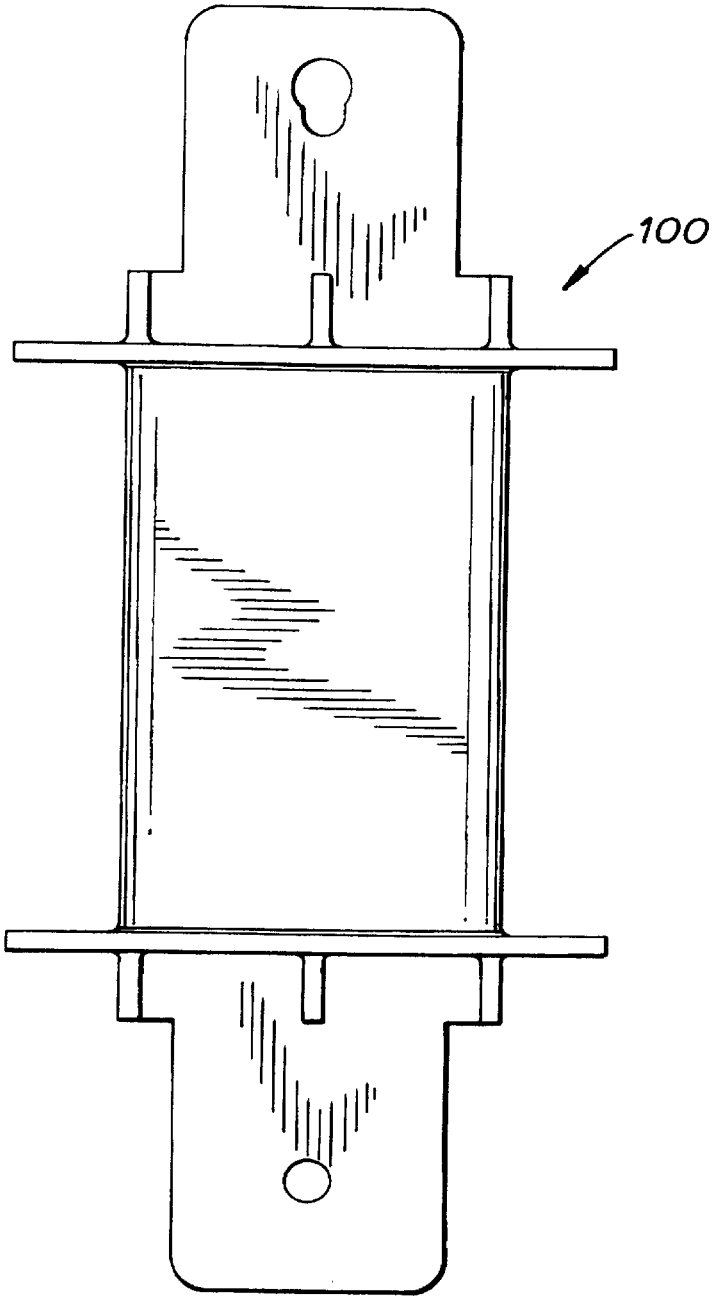
FIG. 8 is a side elevational view of an alternative embodiment of the present invention.

An alternative embodiment of the invention, bobbin 100, is shown in FIG. 8. The bobbin 100 is essentially the same as bobbin 25 except that all of its sides or walls are substantially smooth. Without ridged side walls the bobbin 100 lacks the structural strength of the bobbin 25. Nevertheless, it is suitable for many applications, particularly those where relatively small wire coils made from small diameter wire are used. In these applications, the compression forces on the bobbin during winding are relatively small. Therefore, structural strength is not critical.

Figure 8A:
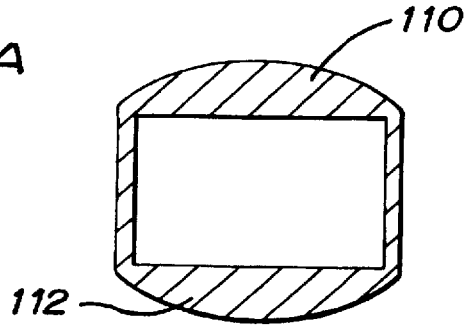
FIG. 8A is a cross-sectional view of an alternative embodiment of the present invention.

FIG. 8A shows yet another embodiment of the present invention, bobbin 108. The bobbin 108 has walls 110 and 112 with a cross-sectional shape, in this instance, a semicircular shape, that increases the strength of the bobbin 100 in comparison to bobbins with rectangularly sectioned walls.

Figure 9:
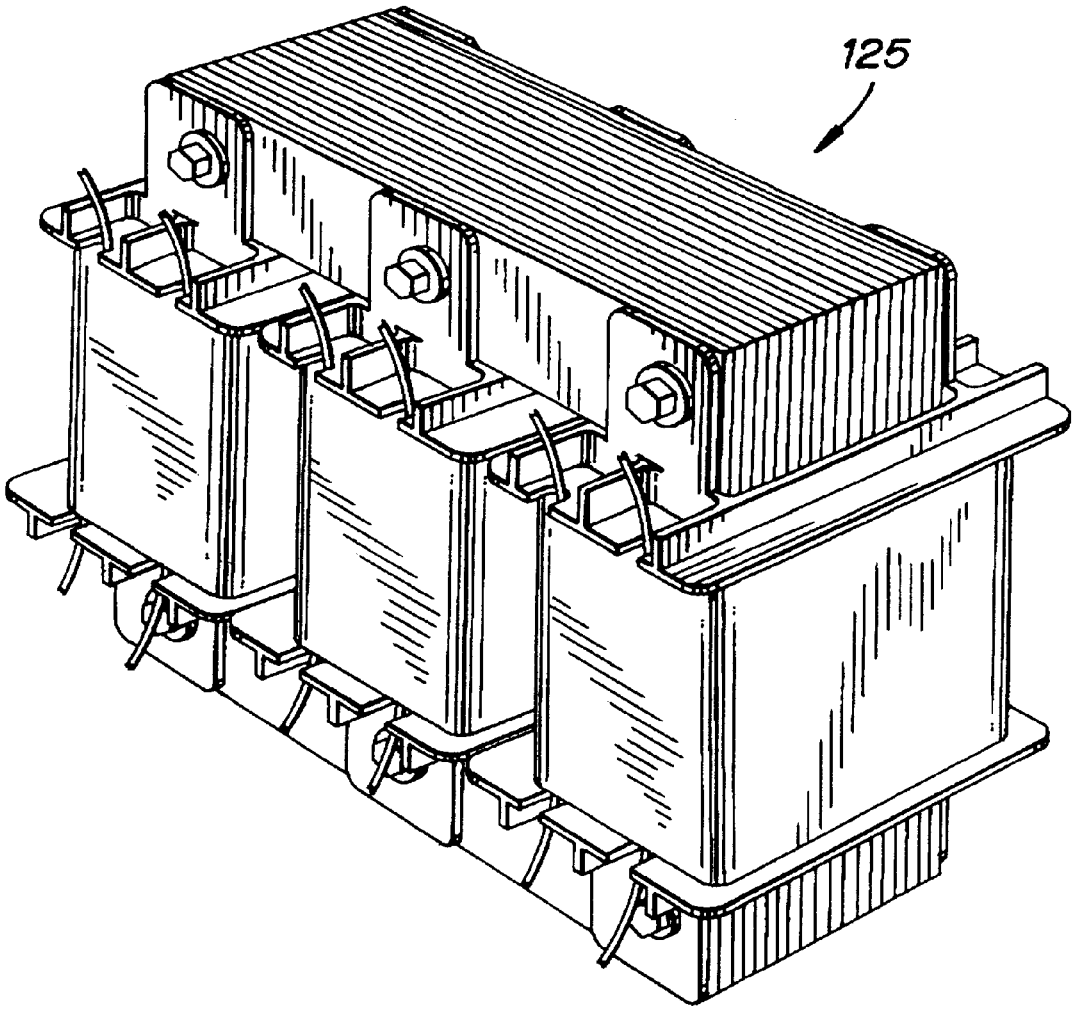
FIG. 9 is a perspective view of a three-phase line reactor constructed with three bobbins made in accordance with the teachings of the present invention.

As can be seen by reference to FIG. 9, three bobbins constructed in accordance with the teachings of the present invention can be readily used to create a three-phase reactor 125. The reactor 125 may be constructed faster and cheaper than prior devices as the problems associated with inserting and aligning metal support bars are eliminated by the provision of the integral tabs on each bobbin. Eddy current loses are also eliminated by removing the metal support bars. Furthermore, the performance of the bobbins and line reactor may be enhanced by forming the bobbins with one of the enhanced side wall construction configurations discussed above.

While the present invention has been described in what is believed to be the most preferred forms, it is to be understood that the invention is not confined to the particular construction and arrangement of the components herein illustrated and described, but embraces such modified forms thereof as come within the scope of the appended claims.

What is claimed is:

1. A bobbin for use in a reactor and holding a coil of wire, the bobbin comprising:

a tubular main body having a first end, a second end, and a core that extends from the first end to the second end;

a first radially-extending flange on the first end of the main body;

a second radially-extending flange on the second end of the main body;

a first tab positioned on the first end of the main body, extending axially from a first side of the core, and having a first bore for receiving a first device to hold components of the reactor;

a second tab positioned on the first end of the main body, extending axially from a second side of the core, opposite of the first side of the core, and having a second bore for receiving the first device to hold components of the reactor together between the first and second tabs;

a third tab positioned on the second end of the main body, extending axially from the first side of the core, and having a third bore for receiving a second device to hold components of the reactor;

a fourth tab positioned on the second end of the main body, extending axially from the second side of the core, opposite the first side of the core, and having a fourth bore for receiving the second device to hold components of the reactor together between the third and fourth tabs; and wherein the tubular main body of the bobbin is rectangularly shaped with first and second opposed sidewalls being substantially smooth, and third and fourth opposed sidewalls each having a longitudinally oriented rib extending outwardly from the third and fourth sidewalls for providing proper camber in the coil of wire.

2. A bobbin as in claim 1, wherein the first and second radially extending flanges each have an outer surface and a ridge perpendicular to the outer surface.

3. A bobbin as in claim 1, further comprising:

a first feed slot positioned on the first end of the main body; and a second feed slot positioned on the second end of the main body.

4. A bobbin for use in a reactor and holding a coil of wire, the bobbin comprising:

a tubular main body having a first end, a second end, and a core that extends from the first end to the second end;

a first radially-extending flange on the first end of the main body;

a second radially-extending flange on the second end of the main body;

a first pair of opposed tabs positioned on the first end of the main body and extending axially from the core, each tab in the first pair of opposed tabs having a bore for receiving a first device to hold components of the reactor together between the first pair of opposed tabs;

a second pair of opposed tabs positioned on the second end of the main body and extending from the core, each tab in the second pair of opposed tabs having a bore for receiving a second device to hold components of the reactor together between the second pair of opposed tabs; and wherein the tubular main body of the bobbin is rectangularly shaped with four sidewalls and a longitudinally oriented rib extending outwardly from at least one of the four sidewalls.

5. A bobbin as in claim 4, wherein the bobbin further comprises opposed sidewalls having a semi-circular shape for enhancing the strength of the bobbin.

6. A bobbin as in claim 4, wherein the at least one sidewall further has a plurality of horizontally oriented ridges.

7. A bobbin as in claim 6, wherein the longitudinally oriented rib extends about 1 mm above the tops of the plurality of horizontally oriented ridges.

8. A bobbin as in claim 6, wherein the at least one sidewall further has two end ridges that are substantially parallel to the longitudinally oriented rib.

9. A three-phase line reactor comprising:

three single-piece bobbins, each wound with wire;

each single-piece bobbin including:

tubular main body having a first end, a second end, and a core that extends from the first end to the second end;

a first radially-extending flange on the first end of the main body;

a second radially-extending flange on the second end of the main body;

a first pair of opposed tabs positioned on the first end of the main body and extending axially from the core, each tab in the first pair of opposed tabs having a bore for receiving a first device to hold components of the reactor together between the first pair of opposed tabs;

a second pair of opposed tabs positioned on the second end of the main body and extending axially from the core, each tab in the second pair of opposed tabs having a bore for receiving a second device to hold components of the reactor together between the second pair of opposed tabs; and wherein the tubular main body of each single-piece bobbin is rectangularly shaped with four sidewalls and a longitudinally oriented rib extending outwardly from at least one of the four sidewalls.

10. A three-phase line reactor as in claim 9, wherein the at least one sidewall of each single-piece bobbin further has a plurality of horizontally-oriented ridges.

11. A three-phase line reactor as in claim 10, wherein the longitudinally oriented rib of the at least one side of the bobbin extends about 1 mm above the tops of the plurality of horizontally oriented ridges.

12. A three-phase line reactor as in claim 10, wherein the at least one side of the bobbin further has two end ridges that are substantially parallel to the longitudinally oriented rib.

* * * * *